US006928674B2

(12) United States Patent
Blackburn

(10) Patent No.: US 6,928,674 B2
(45) Date of Patent: Aug. 16, 2005

(54) SWADDLING BLANKET

(75) Inventor: Nijole Blackburn, Center Harbor, NH (US)

(73) Assignee: The First Years Inc., Avon, MA (US)

( * ) Notice: Subject to any disclaimer, the term of this patent is extended or adjusted under 35 U.S.C. 154(b) by 0 days.

(21) Appl. No.: 10/428,596

(22) Filed: May 1, 2003

(65) Prior Publication Data

US 2004/0216230 A1 Nov. 4, 2004

(51) Int. Cl.[7] ..... A47G 9/08; A41B 13/06

(52) U.S. Cl. ..... 5/482; 5/494; 5/413 R; 5/923; 2/69.5; D2/719

(58) Field of Search ..... 5/482, 485, 486, 5/494, 496, 413 R, 655, 922, 923; 2/69.5, 69; 128/872, 873; D2/719

(56) References Cited

U.S. PATENT DOCUMENTS

| | | | | | |
|---|---|---|---|---|---|
| 218,420 | A | * | 8/1879 | Baker | 2/69.5 |
| 881,640 | A | * | 3/1908 | Wimmel | 604/394 |
| 965,921 | A | * | 8/1910 | Mercey | 2/69 |
| 1,373,378 | A | * | 3/1921 | Backmann | 2/69 |
| 1,583,419 | A | * | 5/1926 | Perl | 5/413 R |
| 1,584,853 | A | * | 5/1926 | Dern | 2/69 |
| 1,678,125 | A | * | 7/1928 | Petrescu | 5/413 R |
| 1,723,644 | A | * | 8/1929 | Collingbourne | 2/69.5 |
| D109,371 | S | * | 4/1938 | Friedman | D2/719 |
| 2,227,751 | A | * | 1/1941 | Idelman | 2/69.5 |
| 2,358,410 | A | * | 9/1944 | Matthesius | 2/69.5 |
| 2,538,420 | A | * | 1/1951 | Junghans | 2/69 |
| 2,657,387 | A | * | 11/1953 | Ketcham | 2/69.5 |
| 2,701,885 | A | * | 2/1955 | Turco | 5/494 |
| 3,034,132 | A | * | 5/1962 | Landsberger et al. | 2/69.5 |
| 3,412,407 | A | * | 11/1968 | Key | 2/69.5 |
| 3,477,065 | A | * | 11/1969 | Hoover | 2/69.5 |
| 3,693,190 | A | * | 9/1972 | Hickling | 2/69.5 |
| 3,739,399 | A | * | 6/1973 | Sheahon | 2/69.5 |
| 3,854,156 | A | * | 12/1974 | Williams | 5/421 |
| 4,125,903 | A | * | 11/1978 | Farrell | 2/69.5 |
| 4,172,300 | A | * | 10/1979 | Miller | 5/424 |
| D269,658 | S | * | 7/1983 | Bor | D2/719 |
| 4,897,885 | A | * | 2/1990 | Lunt | 2/69.5 |
| 4,979,250 | A | | 12/1990 | Troncone et al. | 5/494 |
| 5,044,031 | A | * | 9/1991 | Sherwood et al. | 2/69.5 |
| 5,046,204 | A | * | 9/1991 | Mohler | 5/413 R |
| 5,058,226 | A | * | 10/1991 | Crosby | 5/494 |
| 5,062,168 | A | * | 11/1991 | Kocib | 5/413 R |
| 5,129,406 | A | * | 7/1992 | Magnusen et al. | 128/873 |
| 5,243,724 | A | | 9/1993 | Barnes | 5/482 |
| 5,321,863 | A | | 6/1994 | Yamaguchi et al. | 5/655 |
| 5,341,531 | A | | 8/1994 | Straub et al. | 5/655 |
| 5,367,730 | A | | 11/1994 | Sher | 5/655 |
| D361,686 | S | * | 8/1995 | Stearns | D6/603 |
| D369,054 | S | | 4/1996 | Straub et al. | D6/601 |
| 5,611,095 | A | | 3/1997 | Schneider | 5/482 |
| 5,722,094 | A | * | 3/1998 | Ruefer | 2/69.5 |
| D395,188 | S | * | 6/1998 | Rush | D6/603 |
| 5,852,827 | A | * | 12/1998 | Lear | 2/69.5 |
| D405,635 | S | | 2/1999 | Cohen et al. | D6/603 |
| 5,950,261 | A | | 9/1999 | Hay et al. | 5/482 |
| 6,009,576 | A | | 1/2000 | Gramme et al. | 5/413 R |
| D422,775 | S | * | 4/2000 | Hurr | D2/719 |
| D423,760 | S | * | 5/2000 | Sorenson | D2/719 |

(Continued)

*Primary Examiner*—Robert G. Santos
(74) *Attorney, Agent, or Firm*—Fish & Richardson P.C.

(57) ABSTRACT

A swaddling blanket is provided which includes a tri-fold fabric sheet having a middle section with a pocket secured to an inner side of the fabric sheet on two adjacent sides to form a pouch for receiving an infant feet-first, the pouch being open on two other adjacent sides, and left and right sections bordering the middle section on opposite sides thereof and being of width sufficient to overlap an infant in the middle section pocket. The left and right sections carry cooperating fasteners arranged to releasably secure the left and right sections to each other when overlapped about an infant in the middle section pocket.

11 Claims, 3 Drawing Sheets

U.S. PATENT DOCUMENTS

| | | | | | |
|---|---|---|---|---|---|
| D425,288 | S | | 5/2000 | Cohen et al. | D2/719 |
| D428,683 | S | | 8/2000 | Davis | D2/719 |
| 6,145,932 | A | * | 11/2000 | Hamel-Nyhus et al. | 297/465 |
| D448,142 | S | | 9/2001 | Callan | D2/719 |
| D448,914 | S | * | 10/2001 | Caudill | D2/719 |
| 6,321,389 | B1 | * | 11/2001 | Sankey | 2/69.5 |
| 6,341,397 | B1 | * | 1/2002 | Kliegl et al. | 5/482 |
| 6,415,442 | B1 | | 7/2002 | Smith | 2/69.5 |
| 6,640,340 | B2 | * | 11/2003 | Gibson | 2/69.5 |
| 6,662,390 | B1 | * | 12/2003 | Berger | 5/486 |
| 6,757,922 | B2 | * | 7/2004 | Chancey | 5/482 |
| 6,817,033 | B2 | * | 11/2004 | Bailey | 2/69.5 |
| D501,350 | S | * | 2/2005 | Kelly et al. | D6/603 |
| 2003/0079270 | A1 | * | 5/2003 | Bailey | 2/69.5 |
| 2003/0131411 | A1 | * | 7/2003 | Gibson | 5/482 |
| 2004/0019969 | A1 | * | 2/2004 | Gatten | 5/482 |
| 2004/0216230 | A1 | * | 11/2004 | Blackburn | 5/482 |

* cited by examiner

SWADDLING BLANKET

TECHNICAL FIELD

This invention relates to the field of blankets for wrapping and protecting infants.

BACKGROUND

Newly-born and young babies or infants can be wrapped or swaddled in small baby blankets or receiving blankets to provide warmth, protection and contentment to the baby. Many such blankets lack structure and fasteners to securely wrap the baby while providing ready releasability and access to the baby when necessary.

SUMMARY

In general, in one aspect, the invention provides a swaddling blanket having a tri-fold fabric sheet which includes a middle section with a pocket secured to an inner side of the fabric sheet on two adjacent sides to form a pouch for receiving an infant feet-first, the pouch being open on two other adjacent sides, and left and right sections bordering the middle section on opposite sides thereof, the left and right sections being of width sufficient to overlap an infant in the middle section pocket, the left and right sections carrying cooperating hook and loop fasteners arranged to releasably secure the left and right sections to each other when overlapped about an infant in the middle section pocket.

Implementation of this aspect of the invention may include one or more of the following features in various embodiments. At least one of the left and right sections of the swaddling blanket can be resiliently extensible in a lateral direction. The fasteners can include hook and loop components. At least one of the fasteners of the blanket can be a surface of the fabric sheet.

In another aspect, the invention provides a method of swaddling an infant, the method including placing the infant feet-first into the middle section pocket of a swaddler, according to the first aspect of the invention, wrapping one of the left and right sections over the infant, wrapping the other of the left and right sections over the infant, such that the left and right sections themselves substantially overlap, and releasably engaging the fasteners to retain the left and right sections in their wrapped condition.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
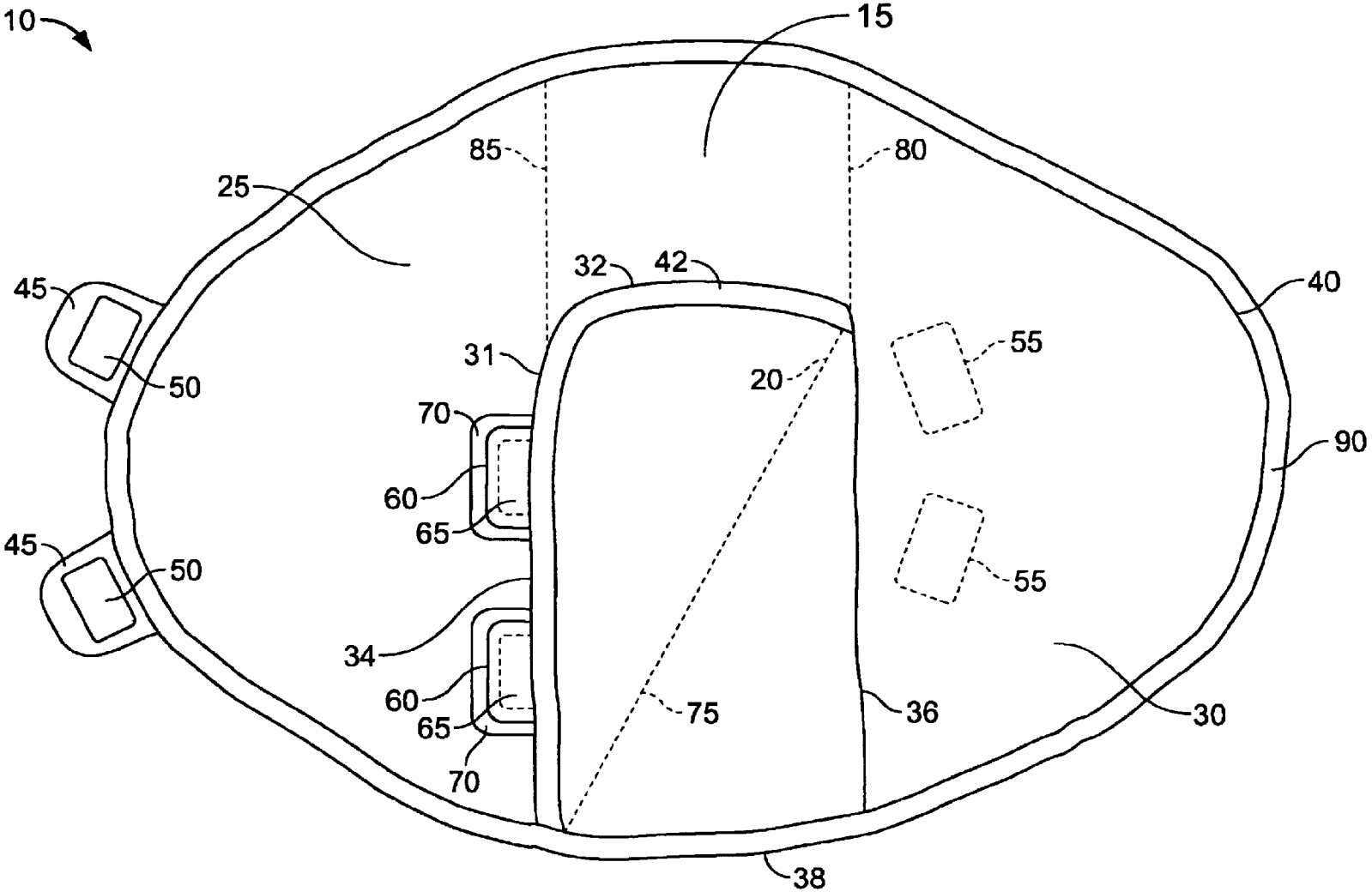
FIG. 1 is a schematic view of the swaddling blanket, according to the invention.

As shown in FIG. 1, a swaddling blanket 10 includes a middle section 15 having a pocket section 20, a left section 25 and a right section 30. The pocket section 20 forms a pouch 31 for receiving an infant and is defined by a horizontal open side 32 of the pocket 20 along the top edge, a vertical open side 34 along the left edge, and a vertical attached side 36 along the right edge and a horizontal attached side 38 along the bottom edge.

The outer dimension of the blanket 10 forms a generally elliptical shape, although other functional shapes are contemplated by the invention. The blanket 10 may also include a hemmed edge 40 about its outer perimeter and a hemmed pocket edge 42 along the horizontal open side 32 and the vertical open side 34 and of the pocket 20. In a preferred embodiment, the overall length of the blanket (top to bottom) is between about 16 and 24 inches, and more preferably, between about 18 and 22 inches and the overall width is between about 28 and 34 inches and more preferably, between about 30 and 32 inches. The pouch 31 is dimensioned to receive and retain an infant when placed therein. In one embodiment, the pouch 31 has a length and width between about 12 and 16 inches. The blanket 10 is preferably made of a lightweight and soft material, such as, for example, toweling or terry knit material, or all cotton or cotton blend pile type material.

One or more fasteners tabs 45 extend from the left section 25 of the blanket 10. A first fastener portion 50 is attached to the each of the fasteners tabs. One or more second fastener portions 55 are arranged along the reverse side of the right section 30 (shown in phantom in FIG. 1 and in FIG. 2B) to engage the first fastener portions 50 when the blanket is wrapped around an infant as will be described below in connection with FIGS. 2A to 2D. The first and second fastener portions 50, 55 may include, for example, hook and loop fastener elements. Other types of fastener are contemplated by the invention. In one alternative embodiment, one or more pocket fastener tabs 60 extend from the vertical open side 34 of the pocket section 20. A first pocket fastener portion 65 is attached to each of the tabs 60 and a second pocket fastener portion 70 is positioned on the left section 25 to releaseably secure the infant in the pouch 31 in an intermediate wrapping position as described in below in connection with FIG. 2A.

Figure 2A:
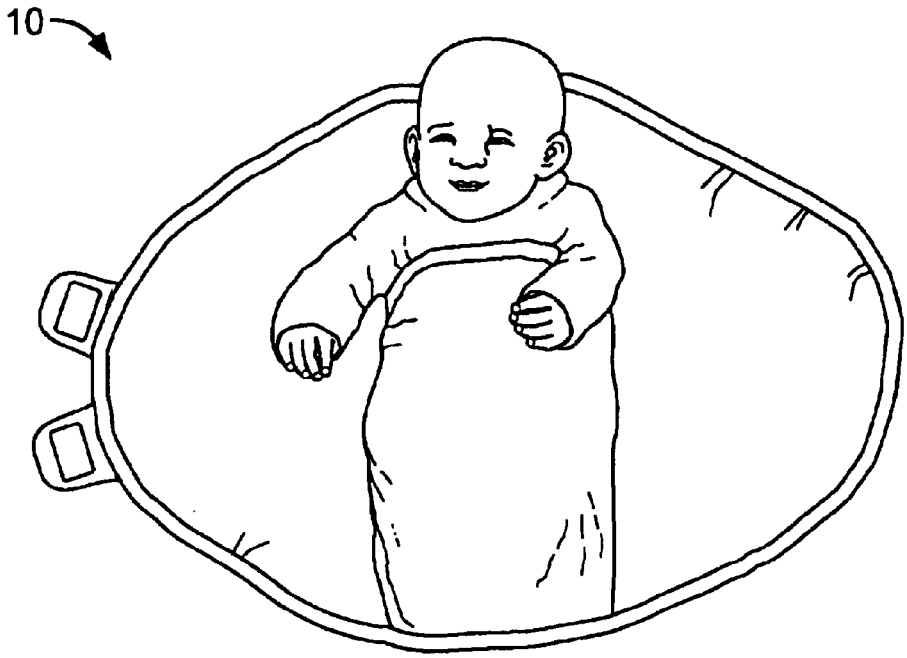
FIGS. 2A to 2D depict the swaddling blanket of FIG. 1 at various stages of wrapping the blanket about an infant.

As shown in FIGS. 2A to 2D, an infant may be secured in the blanket 10 as follows. The infant is placed, feet-first into the pouch 31 formed by the pocket section 20 as shown in FIG. 2A. If necessary to received the infant, the pouch 31 may be further opened by separating the horizontal and vertical open sides 32, 34 from the middle section 15 thereby folding open the pocket section 20 generally along the pocket folding axis 75 (FIG. 1). According to one embodiment, the infant may be releasably secured within the pouch 31 after being placed inside by attaching the first pocket fastener portion 65 of the pocket fastener tab 60 to the second pocket fastener portion 70 of the left section 25.

Figure 2B:
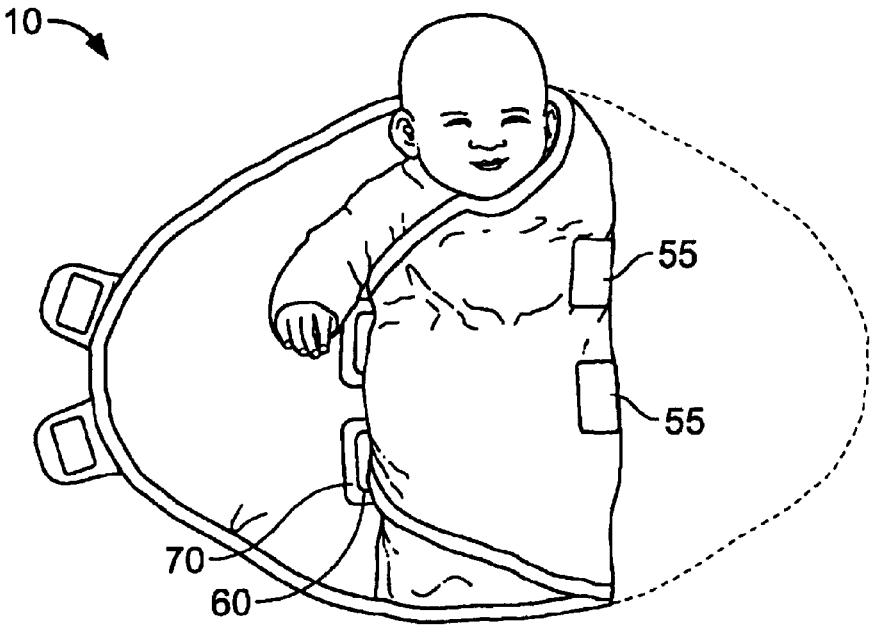

Once the infant is positioned within the pouch 31, the right section 30 is folded generally across the right folding axis 80 (FIG. 1) to the drape the right section 30 across the pocket section 20 as shown in FIG. 2B. This step brings a right edge 90 of the right section 30 proximate to the vertical open side 34 of the pocket section 20. A portion of the right edge 90 may then be tucked under the infant now positioned within the pouch 31.

Figure 2C:
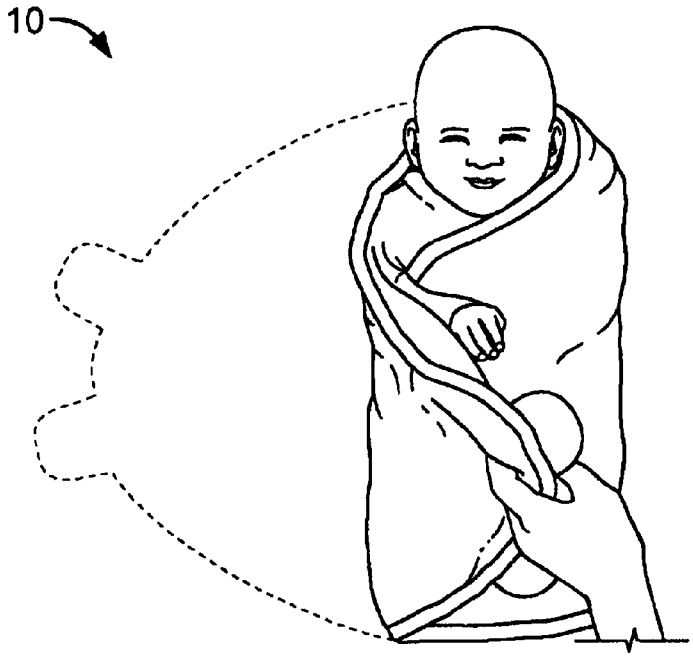

The left section 25 is next folded generally across the left folding axis 85 (FIG. 1) to drape the left section 25 substantially over the portion of the right section 30 that is now covering the pocket section 20 as shown in FIG. 2C. Finally, the first fasteners portions 50 on tabs 45 of the left section 25 are now proximate to the second fastener portions 55 on the reverse side of the right section 30 for releasable engagement of the fastener portions 50, 55 as shown in FIG. 2D.

Figure 2D:
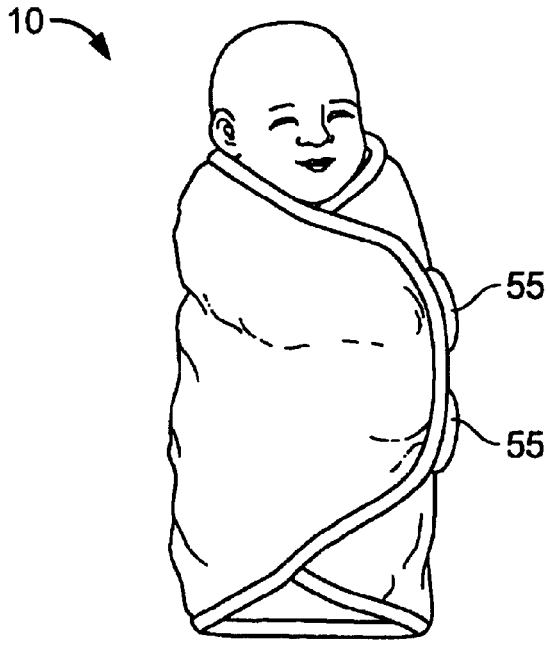

In the arrangement shown in FIG. 2D, the infant is releasably secured in the blanket 10 for greater warmth and contentment owing from a sense of swaddled security. To remove the infant, the steps of FIGS. 2A to 2D are reverse as follows. The fastener portions 50, 55 are separated and the left section 25 is unwrapped from the portion of the right section 30 covering the pocket section 20. The right section 30 is then unwrapped from the pocket section 20 after disengaging the pocket fastener portions 65, 70, if necessary. Finally, the pouch 31 may be opened by separating the horizontal and vertical open sides 32, 34 from the middle section 15 to open the pocket section 20 generally along the pocket folding axis 75 (FIG. 1) for access and removal of the infant from the pouch 31 and the blanket 10.

A number of embodiments of the invention have been described. Nevertheless, it will be understood that various modifications may be made without departing from the spirit and scope of the invention. For example, the swaddling blanket may comprise a generally rectangular or rhomboidal shape and function as described herein. Accordingly, other embodiments are within the scope of the following claims.

What is claimed is:

1. A swaddling blanket comprising a tri-fold fabric sheet, the blanket comprising:

a middle section with a pocket secured to an inner side of the fabric sheet along at least portions of two adjacent sides to form a couch for receiving an infant feet-first, the pouch being open along portions of at least two other adjacent sides; and left and right sections bordering the middle section on opposite sides thereof, the left and right sections being of width sufficient to overlap an infant in the middle section pocket; the left and right sections carrying cooperating fasteners arranged to releasably secure the left and right sections to each other when overlapped about an infant in the middle section pocket, wherein at least one of the left and right sections is formed from a material that stretches in a lateral direction in response to a force and returns to substantially its unstretched dimension when said force is removed.

2. The swaddling blanket of claim 1 wherein the fasteners comprise hook and loop components.

3. The swaddling blanket of claim 2 wherein at least one of the hook and loop components comprise a surface of the fabric sheet.

4. The swaddling blanket of claim 1 wherein the middle section is sized and dimensioned to at least partially cover a back portion of the infant's head.

5. The swaddling blanket of claim 1 wherein the secured adjacent side of the pouch oriented along a substantially vertical direction and the left section proximate the secured adjacent side further comprises cooperating fasteners for releasably securing the infant in the middle section pocket.

6. The swaddling blanket of claim 5 wherein the fasteners comprise hook and loop components.

7. The swaddling blanket of claim 1 wherein overall length is between about 18 and 22 inches.

8. The swaddling blanket of claim 3 wherein the overall width is between about 30 and 32 inches.

9. The swaddling blanket of claim 1 wherein the length of the pocket is between about 12 and 16 inches.

10. The swaddling blanket of claim 1 wherein the height of the pocket is between about 12 and 16 inches.

11. A method of swaddling an infant, the method comprising:

placing the infant feet-first into a middle section pocket of a swaddler, the swaddler comprising the middle section, a left section, a right section, and fasteners secured to the left section and right sections, wherein at least one of the left and right sections is formed from a material that stretches in a lateral direction in response to a force and returns to substantially its unstretched dimension when said force is removed;

wrapping one of the left and right sections of the swaddler over the infant;

extending and wrapping the other of the left and right sections over the infant, such that the left and right sections themselves substantially overlap; and releasably engaging the fasteners to retain the left and right sections in their wrapped condition.

* * * * *